US012291937B2

(12) United States Patent
Ssafwany et al.

(10) Patent No.: US 12,291,937 B2
(45) Date of Patent: May 6, 2025

(54) SELF-SETTING PLUG

(71) Applicant: SAUDI ARABIAN OIL COMPANY, Dhahran (SA)

(72) Inventors: Ali Ssafwany, Safwa (SA); Ali S. Al-Mashhad, Al-Bustan (SA); Rakan Al Yateem, Majidiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/672,622

(22) Filed: May 23, 2024

(65) Prior Publication Data

US 2024/0309728 A1 Sep. 19, 2024

Related U.S. Application Data

(62) Division of application No. 17/662,962, filed on May 11, 2022, now Pat. No. 12,031,405.

(51) Int. Cl.

| | |
|---|---|
| ***E21B 33/134*** | (2006.01) |
| ***E21B 31/12*** | (2006.01) |
| ***E21B 33/13*** | (2006.01) |

(52) U.S. Cl.

CPC ..... *E21B 33/13* (2013.01); *E21B 31/12* (2013.01)

(58) Field of Classification Search

CPC ..... E21B 33/134

See application file for complete search history.

(56) References Cited

U.S. PATENT DOCUMENTS

2010/0071912 A1* 3/2010 Mackenzie ..... E21B 33/134 166/387

2019/0249509 A1 8/2019 Jakkula et al.

* cited by examiner

*Primary Examiner* — William D Hutton, Jr.
*Assistant Examiner* — Avi T Skaist
(74) *Attorney, Agent, or Firm* — Osha Bergman Watanabe & Burton LLP

(57) ABSTRACT

A plug for wellbore tubing includes: an internal portion; a first external portion which surrounds the internal portion; and a second external portion disposed axially adjacent to the first external portion, with respect to a central longitudinal axis of the plug. The second external portion expands to: engage an interior surface of the wellbore tubing in response to a trigger as the plug displaces downhole through the wellbore tubing; and open a passage to permit a fluid to progress to the first external portion. The first external portion expands to engage the wellbore tubing in response to the expansion of the second external portion and upon contact with the fluid. A related method includes providing such a plug, and displacing the plug downhole in the wellbore tubing.

7 Claims, 8 Drawing Sheets

SELF-SETTING PLUG

BACKGROUND

In the hydrocarbon recovery arts, a subsurface safety valve (SSSV) is often installed in a well upper completion, as a component of tubing which arrests well flow in the event of an emergency shut-down or blowout. If such a valve fails, a complex operation (with or without a rig) may be required for replacing it. Accordingly, downhole plugs are also often installed during well intervention operations, with the aid of a slickline or wireline, as a remedial measure or even as a supplementary measure toward well securement. However, such installation of a plug is often not a quick and easy process.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a plug for wellbore tubing, the plug including: an internal portion; a first external portion which surrounds the internal portion; and a second external portion disposed axially adjacent to the first external portion, with respect to a central longitudinal axis of the plug. The second external portion expands to: engage an interior surface of the wellbore tubing in response to a trigger as the plug displaces downhole through the wellbore tubing; and open a passage to permit a fluid to progress to the first external portion. The first external portion expands to engage the wellbore tubing in response to the expansion of the second external portion and upon contact with the fluid.

In one aspect, embodiments disclosed herein relate to a method of utilizing a plug in wellbore tubing. The method includes providing a plug, the plug including: an internal portion; a first external portion which surrounds the internal portion; and a second external portion disposed axially adjacent to the first external portion, with respect to a central longitudinal axis of the plug. The plug is displaced downhole in the wellbore tubing. The second external portion is expanded to: engage an interior surface of the wellbore tubing in response to a trigger as the plug displaces downhole through the wellbore tubing; and opening a passage to permit a fluid to progress to the first external portion. The first external portion is expanded to engage the wellbore tubing upon contact with the fluid.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Broadly contemplated herein, in accordance with one or more embodiments, is a plug that can be inserted and deployed downwardly from the surface and then travel (such as via "free fall") through the wellbore until it reaches a predetermined setting location. Once at that location, the plug can then be set via engaging included slips, and via the swelling of an outer expandable material such as an elastomer.

Figure 1:
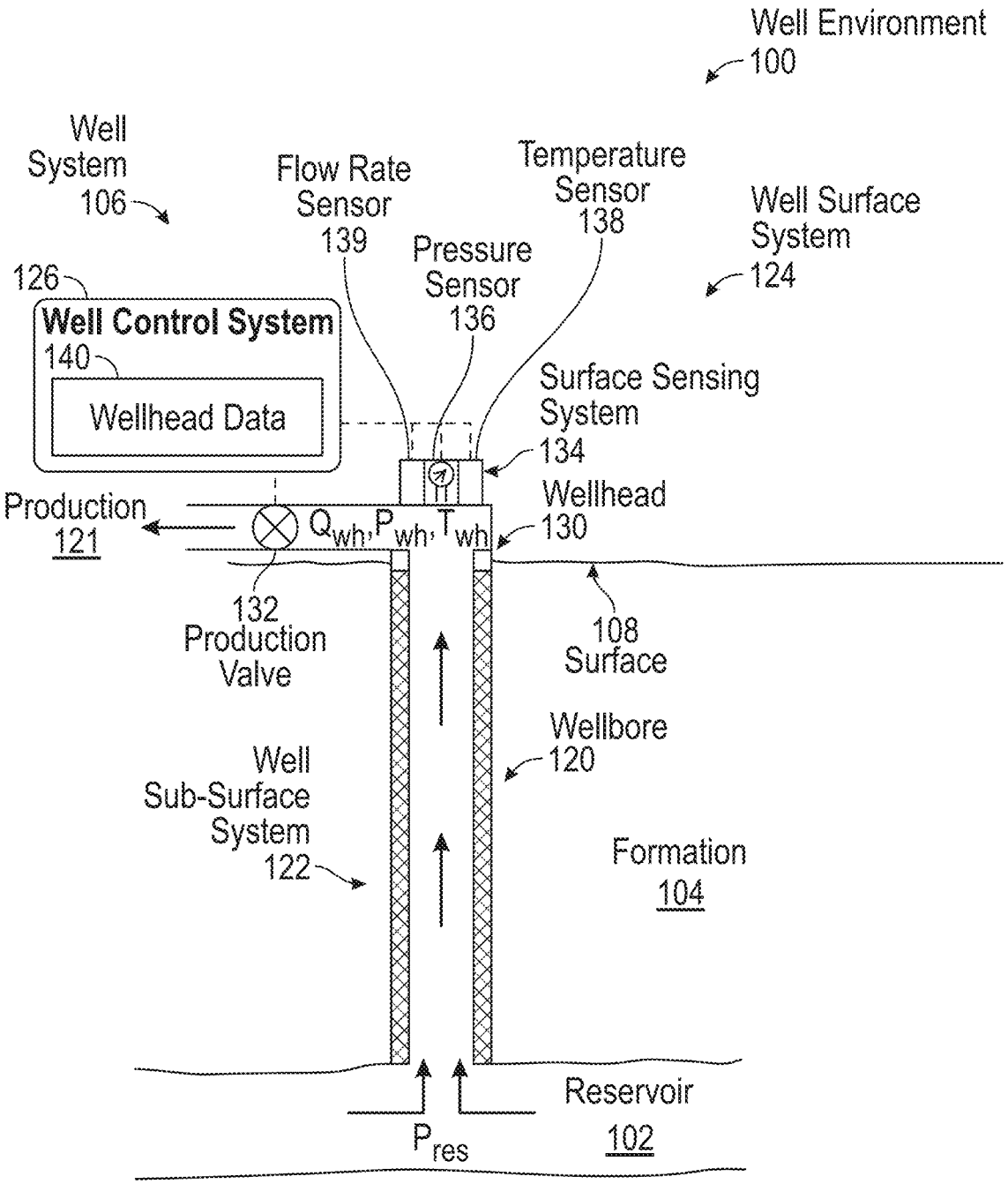
FIG. 1 schematically illustrates, in a cross-sectional elevational view, a conventional wellbore and well control system by way of general background and in accordance with one or more embodiments.

FIG. 1 schematically illustrates, in a cross-sectional elevational view, a wellbore and a well control system in accordance with one or more embodiments. The well system 106 includes a wellbore 120, a well sub-surface system 122, a well surface system 124, and a well control system ("control system") 126. The control system 126 may control various operations of the well system 106, such as well production operations, well completion operations, well maintenance operations, and reservoir monitoring, assessment and development operations.

In accordance with one or more embodiments, the wellbore 120 includes a bored hole that extends from the surface 108 into a target zone of the formation 104, such as the reservoir 102. An upper end of the wellbore 120, terminating at or near the surface 108, may be referred to as the "up-hole" end of the wellbore 120, and a lower end of the wellbore, terminating in the formation 104, may be referred to as the "down-hole" end of the wellbore 120. The wellbore 120 facilitates the circulation of drilling fluids during drilling operations, the flow of hydrocarbon production ("production") 121 (e.g., oil and gas) from the reservoir 102 to the surface 108 during production operations, the injection of substances (e.g., water) into the formation 104 or the reservoir 102 during injection operations, or the communication of monitoring devices (e.g., logging tools) into the formation 104 or the reservoir 102 during monitoring operations (e.g., during in situ logging operations).

In accordance with one or more embodiments, during operation of the well system 106, the control system 126 collects and records wellhead data 140 for the well system 106. The wellhead data 140 may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well 106, and water cut data. Such measurements may be recorded in real-time, to be available for review or use within seconds, minutes, or hours of the condition being sensed (e.g., within one hour). Such real-time data can help an operator of the well 106 to assess a relatively current state of the well system 106, and make real-time decisions regarding development of the well system 106 and the reservoir 102, such as on-demand adjustments in regulation of production flow from the well.

In accordance with one or more embodiments, the well sub-surface system 122 includes a casing installed in the wellbore 120. For example, the wellbore 120 may have a cased portion and an uncased (or "open-hole") portion. The cased portion may include a portion of the wellbore a having casing (e.g., casing pipe and casing cement; see, e.g., 342 in FIG. 3) disposed therein. The uncased portion may include a portion of the wellbore not having casing disposed therein. In embodiments having a casing, the casing defines a central passage that provides a conduit for the transport of tools and substances through the wellbore 120. For example, the central passage may provide a conduit for lowering logging tools into the wellbore 120, a conduit for the flow of production 121 (e.g., oil and gas) from the reservoir 102 to the surface 108, or a conduit for the flow of injection substances (e.g., water) from the surface 108 into the formation 104. The well sub-surface system 122 can include production tubing installed in the wellbore 120. The production tubing may provide a conduit for the transport of tools and substances through the wellbore 120. The production tubing may, for example, be disposed inside casing. In such an embodiment, the production tubing may provide a conduit for some or all of the production 121 (e.g., oil and gas) passing through the wellbore 120 and the casing.

In accordance with one or more embodiments, the well surface system 124 includes a wellhead 130. The wellhead 130 may include a rigid structure installed at the "uphole" end of the wellbore 120, at or near where the wellbore 120 terminates at the Earth's surface 108. The wellhead 130 may include structures (called "wellhead casing hanger" for casing and "tubing hanger" for production tubing) for supporting (or "hanging") casing and production tubing extending into the wellbore 120. Production 121 may flow through the wellhead 130, after exiting the wellbore 120 and the well sub-surface system 122, including, for example, the casing and the production tubing. The well surface system 124 may include flow regulating devices that are operable to control the flow of substances into and out of the wellbore 120. For example, the well surface system 124 may include one or more production valves 132 that are operable to control the flow of production 121. For instance, a production valve 132 may be fully opened to enable unrestricted flow of production 121 from the wellbore 120, the production valve 132 may be partially opened to partially restrict (or "throttle") the flow of production 121 from the wellbore 120, and production valve 132 may be fully closed to fully restrict (or "block") the flow of production 121 from the wellbore 120, and through the well surface system 124.

In accordance with one or more embodiments, the wellhead 130 includes a choke assembly. For example, the choke assembly may include hardware with functionality for opening and closing the fluid flow through pipes in the well system 106. Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system 126. Accordingly, a well control system 126 may obtain wellhead data regarding the choke assembly as well as transmit one or more commands to components within the choke assembly in order to adjust one or more choke assembly parameters.

In accordance with one or more embodiments, the well surface system 124 includes a surface sensing system 134. The surface sensing system 134 may include sensors for sensing characteristics of substances, including production 121, passing through or otherwise located in the well surface system 124. The characteristics may include, for example, pressure, temperature and flow rate of production 121 flowing through the wellhead 130, or other conduits of the well surface system 124, after exiting the wellbore 120.

In accordance with one or more embodiments, the surface sensing system 134 includes a surface pressure sensor 136 operable to sense the pressure of production 121 flowing through the well surface system 124, after it exits the wellbore 120. The surface pressure sensor 136 may include, for example, a wellhead pressure sensor that senses a pressure of production 121 flowing through or otherwise located in the wellhead 130. In some embodiments, the surface sensing system 134 includes a surface temperature sensor 138 operable to sense the temperature of production 121 flowing through the well surface system 124, after it exits the wellbore 120. The surface temperature sensor 138 may include, for example, a wellhead temperature sensor that senses a temperature of production 121 flowing through or otherwise located in the wellhead 130, referred to as "wellhead temperature" ($T_{wh}$). In some embodiments, the surface sensing system 134 includes a flow rate sensor 139 operable to sense the flow rate of production 121 flowing through the well surface system 124, after it exits the wellbore 120. The flow rate sensor 139 may include hardware that senses a flow rate of production 121 ($Q_{wh}$) passing through the wellhead 130.

Figure 2:
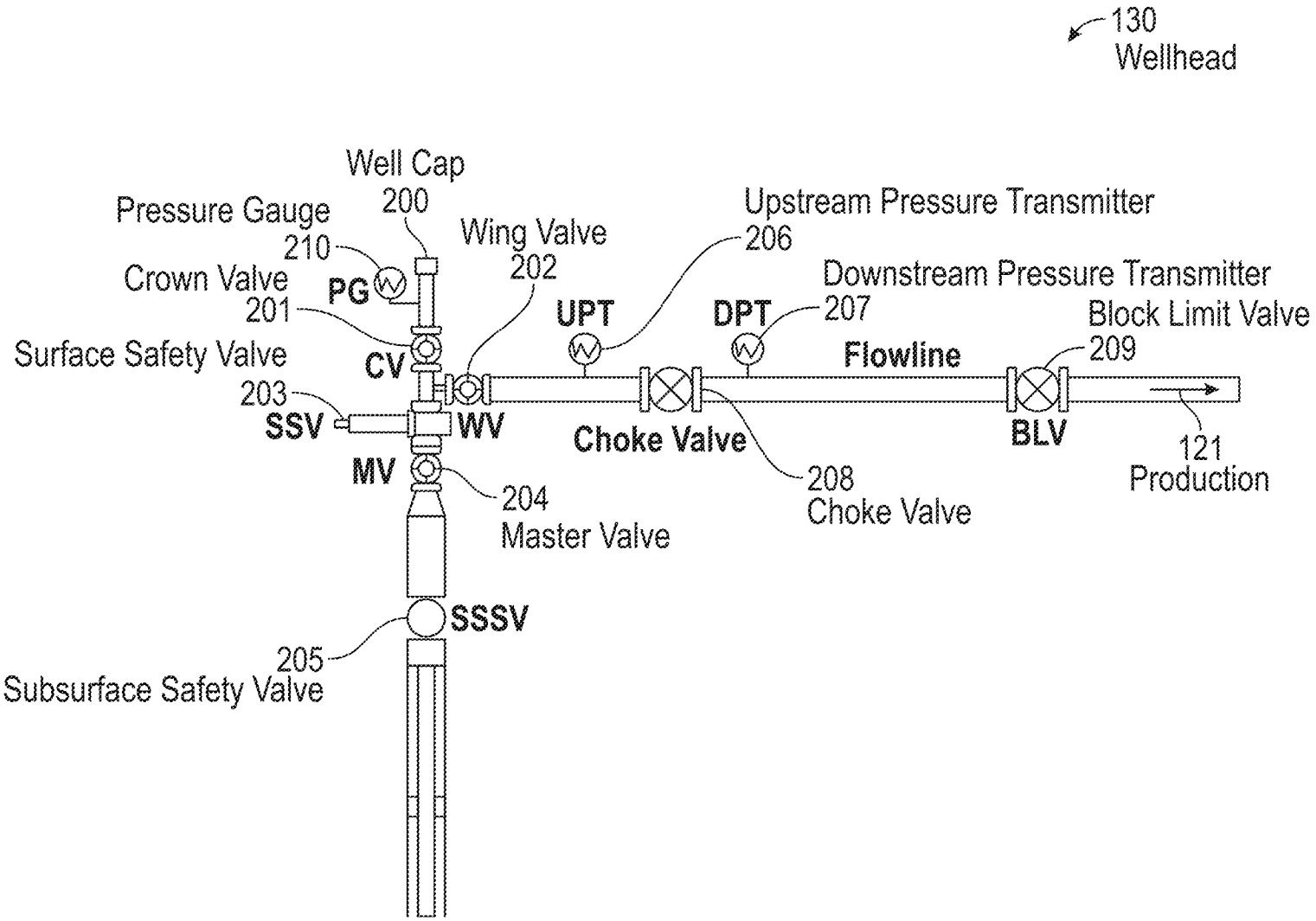
FIG. 2 illustrates, in elevational view, a wellhead, and related components, employed for the wellbore and well control system of FIG. 1, by way of general background and in accordance with one or more embodiments.

FIG. 2 illustrates, in elevational view, a wellhead, and related components, employed for the wellbore and well control system of FIG. 1, in accordance with one or more embodiments. As such, one or more of the modules and/or elements shown in FIG. 2 may be omitted, repeated, and/or substituted. Accordingly, embodiments should not be considered limited to the specific arrangements of modules and/or elements shown in FIG. 2.

In accordance with one or more embodiments, FIG. 2 illustrates details of the wellhead 130 and the flowline for the production 121 depicted in FIG. 1 above. As shown, the wellhead 130 includes a well cap 200, a crown valve 201, a wing valve 202, a surface safety valve 203, a master valve 204, a subsurface safety valve (SSSV) 205, an upstream pressure transmitter 206, a downstream pressure transmitter 207, a choke valve 208, and a plot limit valve 209. The crown valve 201, wing valve 202, surface safety valve 203, master valve 204, choke valve 208, and plot limit valve 209 are referred to as valves at the wellhead. In addition, a pressure gauge 210 and/or temperature gauge (not shown) is permanently installed between the crown valve 201 and the well cap 200. The pressure gauge 210 and/or temperature gauge (not shown) correspond to the pressure sensor 136 and temperature sensor 138, respectively, depicted in FIG. 1 above.

In accordance with one or more embodiments, the well cap 200 provides access to wellbore for interventions with wireline, coil tubing, slickline etc. The crown valve 201 is the uppermost valve on wellhead. Typically, the crown valve 201 is closed until there is a need to access the well as described above. The wing valve 202 is for production flow control. In the case of needing to enter a well, this valve would be closed and the master valve would be open. The surface safety valve 203 is typically a hydraulic failsafe close valve located at surface. The surface safety valve 203 used in the event of an issue in the wellbore/surface equipment and for testing. The master valve 204 is the main valve controlling flow from the wellbore. The SSSV 205 is another safety device located below the surface, e.g., several hundred plus feet below the surface. The SSSV 205 makes up part of the production tubing and provides an arrangement for safety closure in the case of uncontrolled release of hydrocarbons, such as a kick. Also, the SSSV 205 may be used as a barrier when testing or needed to perform maintenance on the wellhead.

In accordance with one or more embodiments, the choke valve 208 is used for flow restriction in the event of bleeding down pressure during testing, loss of pressure in the wellbore, temperature management, etc. The upstream pressure transmitter 206 is a pressure/temperature gauge located upstream of choke valve 208 and provides pressure data prior to reaching the choke valve 208. The downstream pressure transmitter 207 is a pressure/temperature gauge downstream of choke valve 208 and provides pressure data after passing the choke valve 208. The plot limit valve 209 is a valve for testing, maintenance and isolation purposes, e.g., if the upstream pressure transmitter 206, downstream pressure transmitter 207, or choke valve 208 were being replaced. The pressure gauge 210 located above the crown valve 201 is for testing each component of the wellhead. As generally understood, shut-in wellhead pressure (SIWHP) refers to the initial wellhead pressure from the reservoir as seen at surface and is a base line pressure for testing purposes, and can be measured by the pressure gauge 210.

The disclosure now turns to working examples of a self-setting plug in accordance with one or more embodiments, as described and illustrated with respect to FIGS. 3-7. It should be understood and appreciated that these merely represent illustrative examples, and that a great variety of possible implementations are conceivable within the scope of embodiments as broadly contemplated herein.

Figure 3:
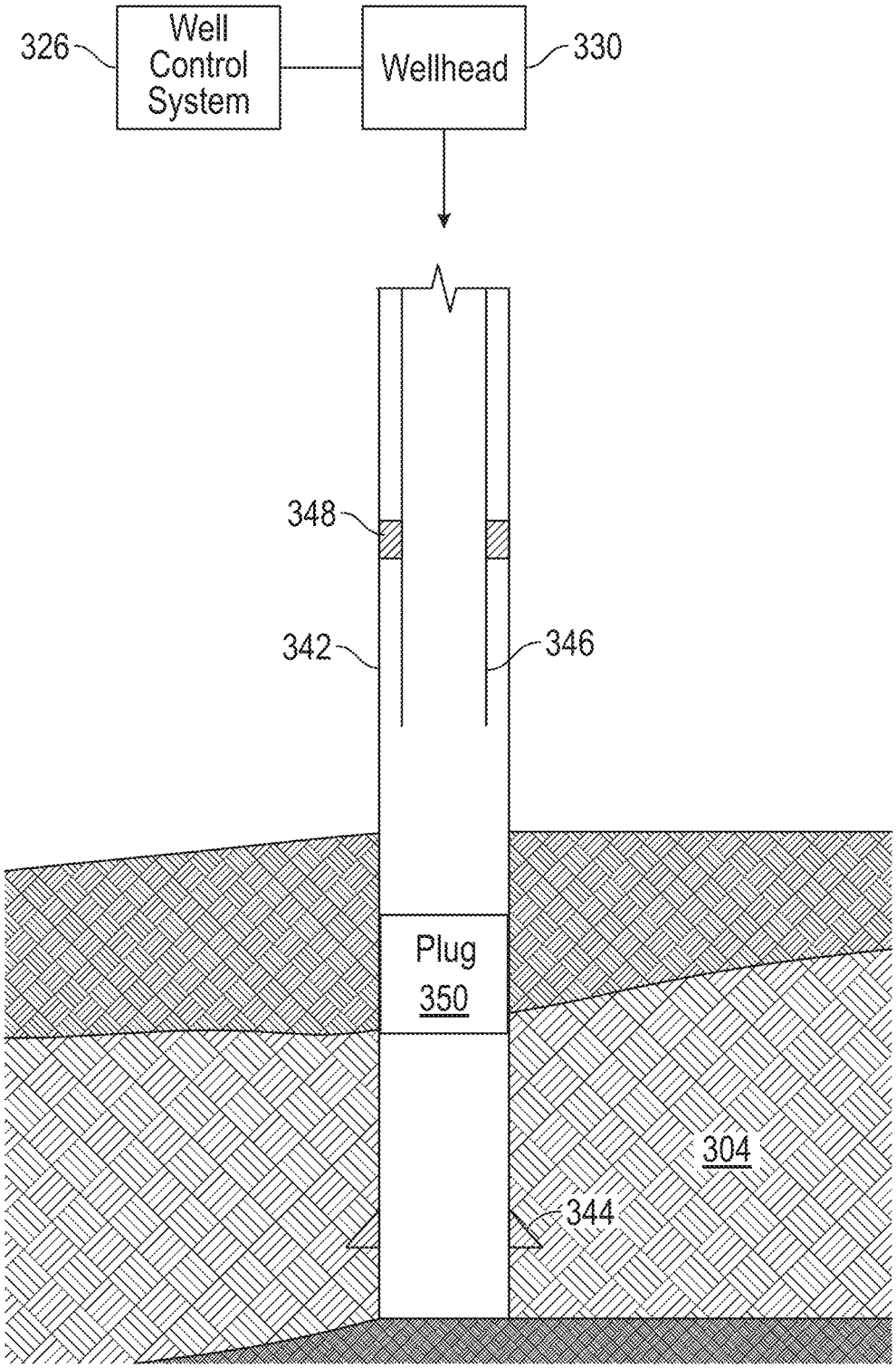
FIG. 3 schematically illustrates, in a cross-sectional elevational view, a production wellbore in accordance with one or more embodiments.

FIG. 3 schematically illustrates, in a cross-sectional elevational view, a production wellbore in accordance with one or more embodiments. In the illustrated working example, a well has been drilled and completed for oil production, with a casing 342 cemented into place and a casing shoe 344 set across formation rock 304 at a predetermined depth. Production tubing 346, for recovering hydrocarbons from the formation rock 304 (or other subsurface regions), is then installed and nested coaxially within the casing 342. Further, as is generally known, a packer 348 may be included to seal the annular chamber between the casing 342 and production tubing 346. Also illustrated is a wellhead 330 in communication with a well control system 326; these may function and be configured analogously to the wellhead 130 and well control system 126, respectively, that are described and illustrated with respect to FIGS. 1-2.

Also illustrated in FIG. 3 is a self-setting plug 350 installed in accordance with one or more embodiments. As shown, the self-setting plug 350 is disposed across a full inner diameter of casing 342, at a predetermined location downhole. The well may be secured for any of a variety of reasons, such as in the event of SSSV failure as noted previously. Generally, the well may be secured to stop the flow of hydrocarbons to the surface at least temporarily, e.g., until a rig arrives for workover of the well. For instance, there may be an issue with securely sealing the annular chamber between the casing 342 and production tubing 346, and a workover may be ordered to replace or fix one or more wellhead components (such as SSSV 205 or other components shown in FIG. 2), thus warranting full securement of the well.

Figure 4:
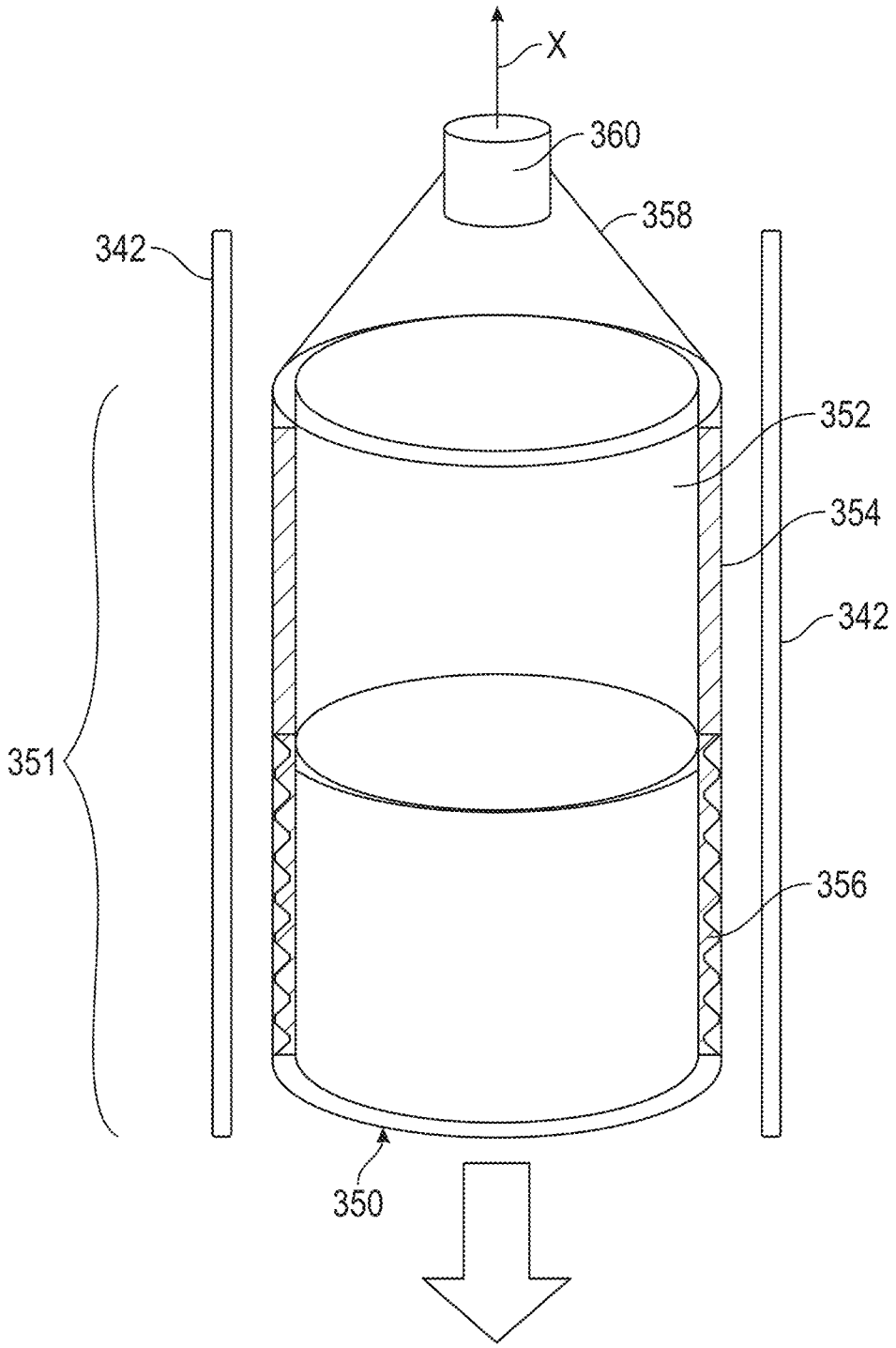
FIG. 4 schematically illustrates, in an isometric elevational view, a self-setting plug disposed within casing in a pre-set configuration, in accordance with one or more embodiments.

FIG. 4 schematically illustrates, in an isometric elevational view, the self-setting plug 350 disposed within casing 342 in a pre-set configuration, in accordance with one or more embodiments. As shown, plug 350 may include a main body 351 having three main components: an internal portion 352; a first external portion 354 and a second external portion 356. As will be further discussed below, internal portion 352 may be formed from a heavier material, first external portion 354 may include a sealing element, and second external portion 356 may include slips. Extending from a proximal or uphole end of the main body 351, a conical section 358 interconnects the main body 351 with a fishing neck 360. Here, the plug 350 is shown within casing 342, before it has been set to extend across the full internal diameter of casing 342. It should also be understood that while plug 350 is shown here within casing 342, it may be deployed or utilized essentially within any tubing, casing or liner in a wellbore as deemed suitable for the task at hand. As such, casing 342 may alternatively be termed "wellbore tubing".

In accordance with one or more embodiments, the internal portion 352 is formed from a solid, non-buoyant material of sufficient weight to overcome buoyancy forces while the plug is deployed (such as via free fall) to a desired setting depth. It can be appreciated that a wide variety of commercially available materials, well-known to those of ordinary skill in the art, are suitable for the purpose. Such materials, e.g., can also include capabilities for temperature resistance and resistance to corrosive effects of hydrogen sulfide. Internal portion 352 may extend along a full axial length of the plug 350 (i.e., in a direction along a central longitudinal axis X of plug 350). The first external portion 354, surrounding the internal portion, can be formed from a material—such as an elastomer—that swells upon contact with a fluid (such as oil or water). The swelling effect permits first external portion 354 to expand until it engages an interior surface of casing 342; that is, until it fully contacts the interior surface of casing 342 and seals off reservoir pressure downhole from plug 350. Essentially any suitable elastomer that swells when exposed to oil, water or both may be utilized with first external portion 354; several such elastomers are commercially available and well-known to those of ordinary skill in the art.

In accordance with one or more embodiments, the second external portion 356 is located axially adjacent to the first external portion 354, toward a distal or downhole end of plug 350. The second external portion 356 may be embodied by slips as generally known in the hydrocarbon recovery arts. The slips thus may be deployed to expand radially outwardly (with respect to a central longitudinal axis X of plug 350) to engage the interior surface of casing 342 and thus provide a gripping effect to hold the plug 350 in place within casing 342.

In accordance with one or more embodiments, fishing neck 360 permits the plug 350 to be retrieved via any of a variety of well intervention methods. For instance, a slickline may be deployed into the wellbore to hook onto the fishing neck 360 and pull the plug 350 uphole. As part of such a retrieval process, tension applied to first external portion 354 via the fishing neck 360 may effectively elongate the first external portion 354 and reduce its outer diameter.

In accordance with one or more embodiments, in the pre-set configuration shown in FIG. 4, the slips of second external portion 356 are retracted radially inwardly, and the sealing element of first external portion 354 is likewise in a retracted position is likewise in a "retracted" position of minimal outer diameter. However, in a manner to be described, the slips of second external portion 356 may be actuated to expand radially outwardly and trigger expansion of the sealing element of first external portion 354 as well.

In accordance with one or more embodiments, when in the pre-set configuration shown in FIG. 4, the plug 350 may be deployed downhole within casing 342, i.e., in the direction shown by the block arrow, until it reaches a predetermined position and then transitions to a set configuration as described below. Plug 350 may free-fall downhole by virtue of the heavier material of internal portion 352, or may be lowered downhole at a predetermined rate via another mechanism such as a slickline. If the plug 350 is deployed downhole via free-fall, it may be with or without a slickline or other line attached.

Figure 5A:
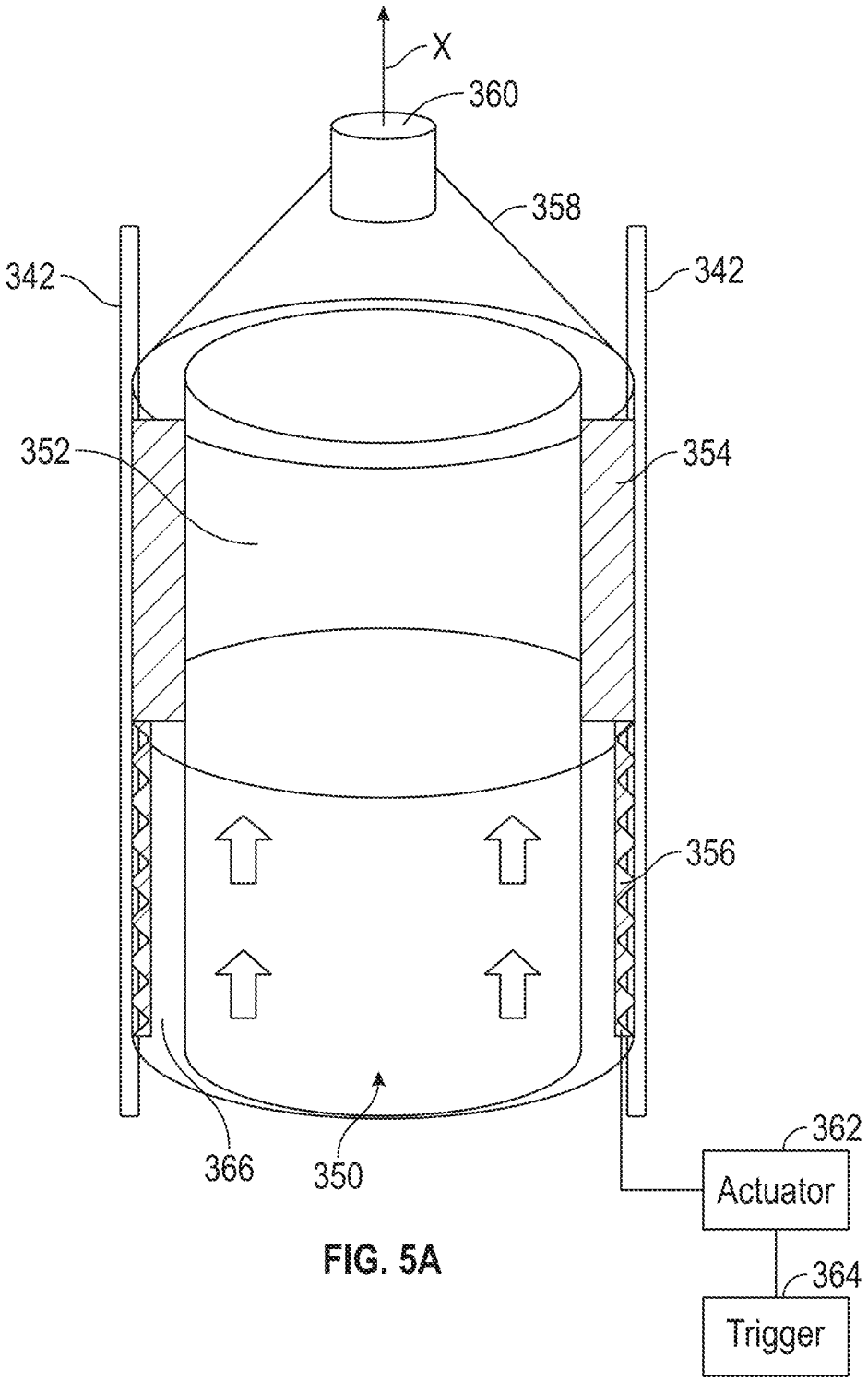
FIG. 5A provides essentially the same view as FIG. 4, but schematically illustrates the plug in a set configuration, in accordance with one or more embodiments.

FIG. 5A provides essentially the same view as FIG. 4, but schematically illustrates the plug 350 in a set configuration, in accordance with one or more embodiments. Here, once the plug 350 has been deployed downhole to a predetermined position, an actuator 362 is triggered by a trigger 364 and causes the slips of second external portion 356 to expand radially outwardly and engage the interior surface of casing 342, thus providing a gripping effect to hold the plug 350 in place within casing 342. Additionally, when the slips of second external portion 356 so expand radially outwardly an annular gap 366 is created between second external portion 356 and internal portion 352, to permit fluid (such as oil or water) to progress in an uphole direction, indicated by the small block arrows, to the sealing element of first external portion 354. In accordance with an alternative embodiment, a passage other than an annular gap may be so opened (e.g., a conduit or tube).

In accordance with one or more embodiments, when fluid accesses the sealing element of first external portion 354 through annular gap 366, the elastomer of the sealing element swells to expand until it fully contacts the interior surface of casing 342, and seals off reservoir pressure downhole from plug 350. Generally, and similarly to the principle of a soluble packer, the sealing element of first external portion 354 may be surrounded by a material which does not swell upon contact with fluid, in order to prevent initial contact with oil or water as the plug 350 is deployed downhole and before the slips of second external portion 356 engage to permit oil or water to flow to the sealing element of first external portion 354.

In accordance with one or more embodiments, the trigger 364 may be a mechanical implement located within the casing 342 that physically interacts with the plug 350 as the plug 350 is deployed downhole (e.g., via free-fall or lowering via a slickline). The mechanical implement may be a nipple as generally known to those of ordinary skill in the art, i.e., a segment of casing, tubing or liner with at least one portion providing reduced inner diameter. For instance, such a nipple may be embodied by an "X" or "XN" type of nipple as generally known. In this case, the nipple and its components would be sufficient to stop the downhole displacement of the plug 350 if the reduced inner diameter (as mentioned) is smaller than an outer diameter of second external portion 356. As an alternative, the trigger 364 may be embodied by essentially any suitable protrusion, directed radially inwardly from the inner surface of the casing 342, that likewise stops the downhole displacement of the plug 350. The actuator 362 may then be embodied by a mechanical actuator within plug 350 that causes the slips of second external portion 356 to expand radially outwardly as noted heretofore.

Figure 5B:
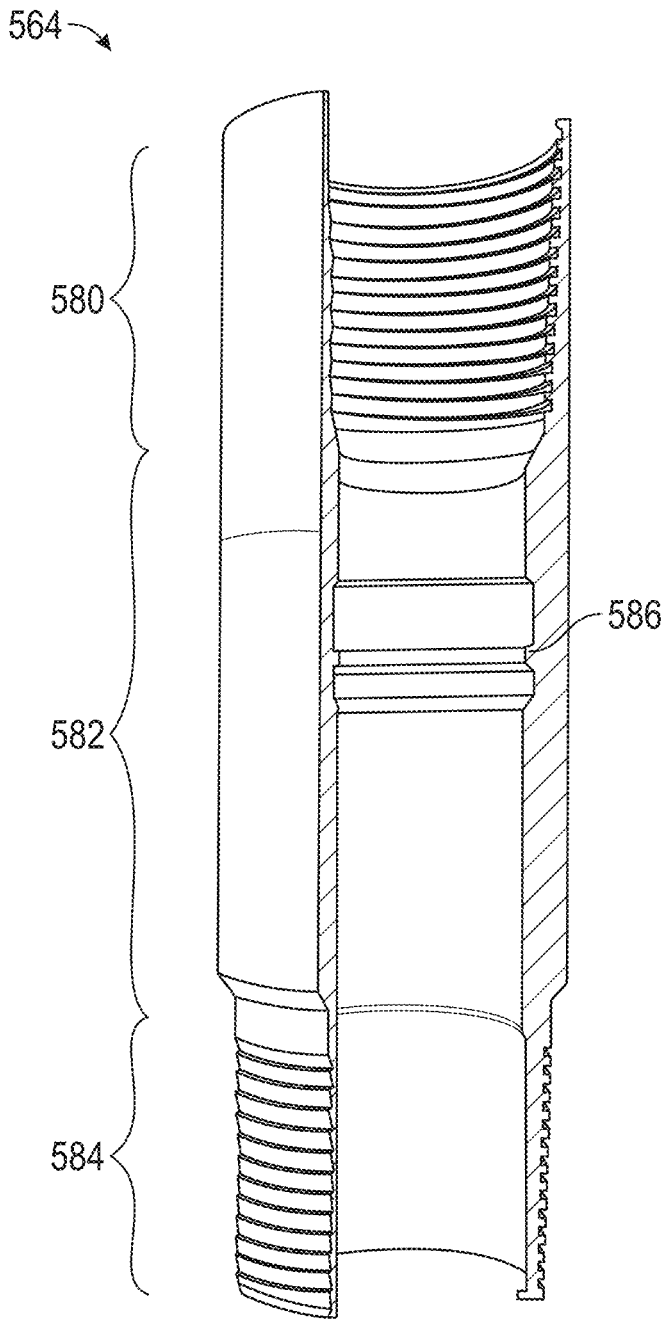
FIG. 5B provides a cut-away elevational view of a nipple, in accordance with one or more embodiments.

In accordance with one or more embodiments, FIG. 5B provides a cut-away elevational view of a nipple 564. Thus by way of an illustrative working example, nipple 564 may be utilized as the trigger 364 shown in FIG. 5A. As shown, nipple 564 may include first, second and third portions 580, 582, and 584, respectively, in succession along an axial direction of nipple 564 (from top to bottom in the drawing). First portion 580 may include internal threading for connecting with another casing or tubing component. Second portion 582 may be internally profiled or shaped in any suitable manner, including as known in connection with no-go or selective landing nipples. In this connection, second portion 582 may include a key profile or ledge 586 which protrudes radially inwardly to provide a smaller effective inner diameter than other portions of the nipple 564. Thus, such a key profile or ledge 586 may be sufficient to stop downhole displacement of the plug 350 as discussed above. Third portion 584, for its part, may include external threading for connecting with another casing or tubing component.

In accordance with one or more embodiments, the trigger 364 may alternatively be embodied by a timer, a pressure sensor or a depth sensor. Such a trigger 364 may be suitably built into the body of the plug 350 itself. Accordingly, once a predetermined time is reached, or a predetermined threshold (ambient) pressure or depth value is detected, trigger 364 will prompt actuator 362 to activate the slips of second external portion 356. Again, the actuator 362 may be embodied here by a mechanical actuator within plug 350 that causes the slips of second external portion 356 to expand radially outwardly as noted heretofore. Essentially any simple, suitable mechanical actuator maybe utilized in this vein. For instance, the trigger 364 may cause an actuator in the form of one or more movable rods, translatable in an axial direction of plug 350, to displace axially and, via a mechanical linkage, cause the slips of the second external portion 356 to deploy or displace in a radially outward direction.

Figure 6:
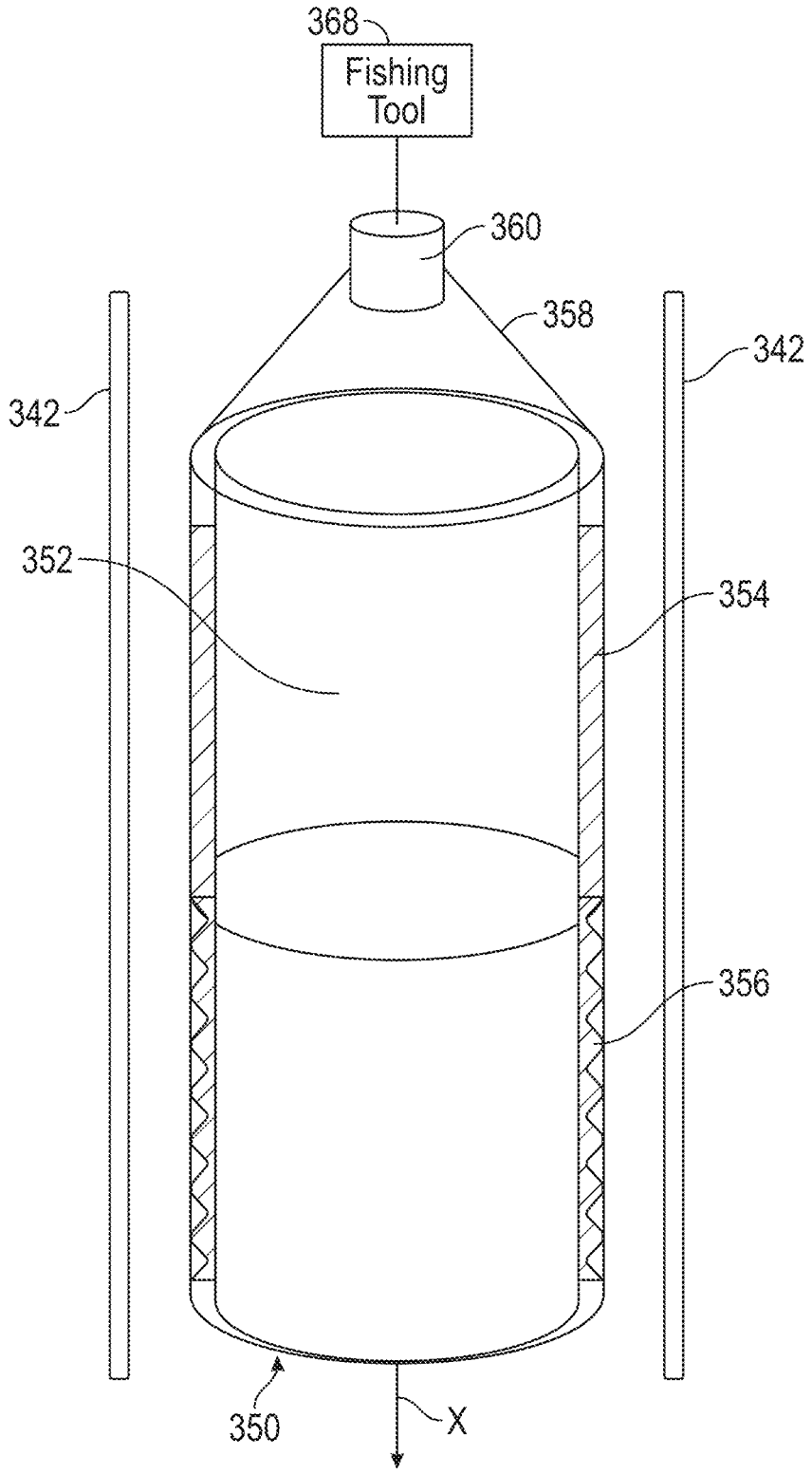
FIG. 6 provides essentially the same view as FIGS. 4 and 5, but schematically illustrates the plug in a retrieval configuration, in accordance with one or more embodiments.

FIG. 6 provides essentially the same view as FIGS. 4 and 5, but schematically illustrates the plug 350 in a retrieval configuration, in accordance with one or more embodiments. Here, a fishing tool 368 such as a slickline or analogous implement can hook or engage the fishing neck 360 to disengage the plug 350 from the interior surface of casing 342 and pull the plug 350 uphole. A shear pin, connected to the fishing neck 360, can help establish a threshold tensile force beyond which the pin breaks and permits application of an even greater tensile force to effectively elongate the sealing element of first external portion 354 and decrease its outer diameter. As part of the same process, the slips of second external portion 356 may be released such that they also return to their retracted position radially inwardly.

Figure 7:
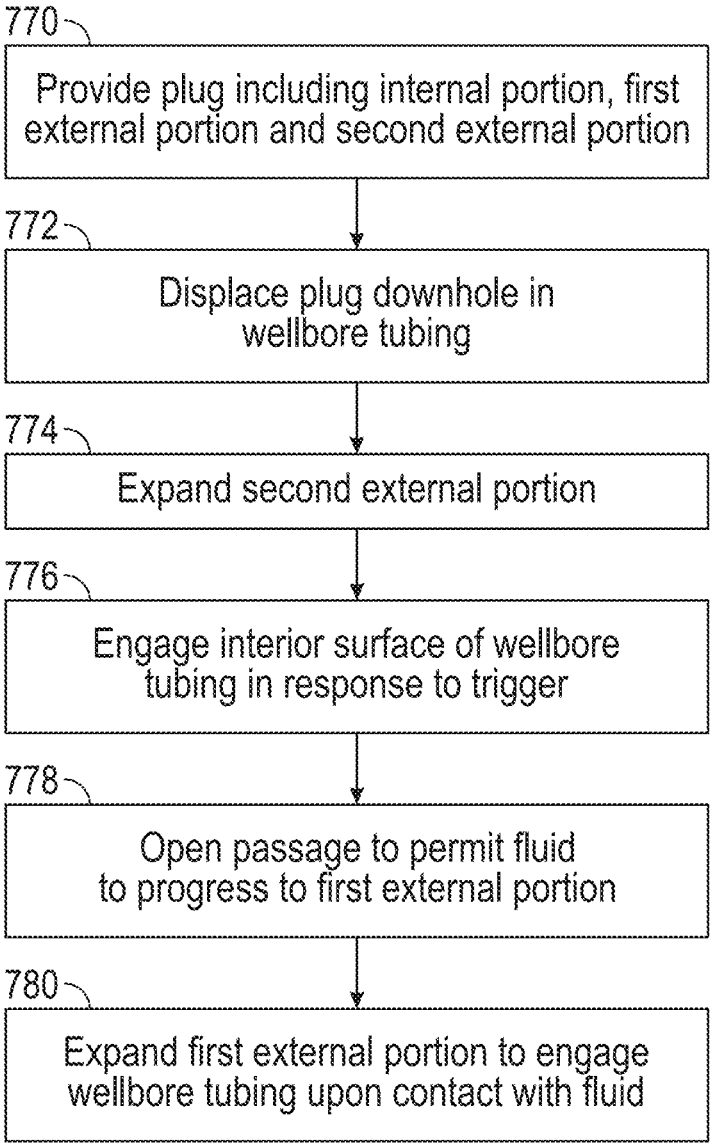
FIG. 7 shows a flowchart of a method in accordance with one or more embodiments.

FIG. 7 shows a flowchart of a method, as a general overview of steps which may be carried out in accordance with one or more embodiments described or contemplated herein.

As such, in accordance with one or more embodiments, a plug is provided wherein the plug includes an internal portion, a first external portion which surrounds the internal portion, and a second external portion disposed axially adjacent to the first external portion, with respect to a central longitudinal axis of the plug 770. By way of example, this may correspond to the plug 350 and related components described and illustrated with respect to FIG. 4. The plug is displaced downhole in the wellbore tubing 772, and the second external portion is expanded 774 to engage an interior surface of the wellbore tubing in response to a trigger as the plug displaces downhole through the wellbore tubing 776 and open a passage to permit a fluid to progress to the first external portion 778. By way of example this may correspond to use of the trigger 364 and expansion of the slips of second external portion 356, as described and illustrated herein. The first external portion is expanded to engage the wellbore tubing upon contact with the fluid 780. By way of example, this may correspond to expansion off the sealing element of first external portion 354, as described and illustrated herein.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method of utilizing a plug in wellbore tubing, the method comprising:
   - providing a plug comprising:
     - an internal portion;
     - a first external portion which surrounds the internal portion; and
     - a second external portion disposed axially adjacent to the first external portion, with respect to a central longitudinal axis of the plug;
   - displacing the plug downhole in the wellbore tubing;
   - expanding the second external portion to:
     - engage an interior surface of the wellbore tubing in response to a trigger as the plug displaces downhole through the wellbore tubing; and
     - create an annular gap between the second external portion and the internal portion to permit a fluid to progress in an uphole direction to the first external portion; and
   - expanding the first external portion to engage the wellbore tubing upon contact with the fluid.

2. The method according to claim 1, wherein during the displacing the plug free-falls downhole in the wellbore tubing.

3. The method according to claim 1, wherein expanding the second external portion comprises engaging slips with an internal surface of the wellbore tubing, to provide a gripping effect to hold the plug in place within the wellbore tubing.

4. The method according to claim 1, wherein:
   - the first external portion comprises a sealing element which swells upon contact with the fluid; and
   - expanding the first external portion comprises swelling the sealing element to contact the interior surface of the wellbore tubing and seal off reservoir pressure downhole from the plug.

5. The method according to claim 1, further comprising actuating the second external portion to expand in response to the trigger.

6. The method according to claim 5, wherein the trigger comprises one or more of: a mechanical trigger; a sensor; and a timer.

7. The method according to claim 1, wherein the plug comprises a fishing neck and the method further comprises:
   - engaging a fishing tool with the fishing neck; and
   - pulling the plug in an uphole direction with the fishing tool;
   - whereby an outer diameter of at least a portion of the plug is reduced.

* * * * *